United States Patent [19]

Monday

[11] Patent Number: 4,850,583

[45] Date of Patent: Jul. 25, 1989

[54] DOCUMENT TRANSPORT DEVICE

[75] Inventor: William C. Monday, Rowlett, Tex.

[73] Assignee: Recognition Equipment Incorporated, Irving, Tex.

[21] Appl. No.: 152,255

[22] Filed: Feb. 4, 1988

[51] Int. Cl.[4] ..... B65H 5/02

[52] U.S. Cl. ..... 271/240; 271/250; 271/272

[58] Field of Search ..... 271/248, 250, 251, 252, 271/161, 188, 209, 240, 275, 272–274, 198

[56] References Cited

U.S. PATENT DOCUMENTS

| | | | |
|---|---|---|---|
| 415,267 | 11/1889 | Hart | 271/188 |
| 1,986,305 | 1/1935 | Tropp | 271/63 |
| 2,060,400 | 11/1936 | Nieman | 153/54 |
| 2,672,337 | 3/1954 | Lorig | 271/240 |
| 2,880,998 | 4/1959 | Middleton | 271/45 |
| 3,421,754 | 1/1969 | Schaller | 271/61 |
| 3,738,642 | 6/1973 | Blaire | 271/272 X |
| 3,791,516 | 2/1974 | Tramposch | 209/74 |
| 3,854,315 | 12/1974 | Winkler | 72/165 |
| 4,009,877 | 3/1977 | Ward | 271/272 |
| 4,106,767 | 8/1978 | Schirmeister | 271/188 |
| 4,174,104 | 11/1979 | Garvey | 271/272 |
| 4,196,846 | 4/1980 | Kao et al. | 235/475 |
| 4,228,953 | 10/1980 | Ingram et al. | 235/480 |
| 4,469,319 | 9/1984 | Robb et al. | 271/3.1 |

FOREIGN PATENT DOCUMENTS

| | | | |
|---|---|---|---|
| 490051 | 8/1938 | United Kingdom | 271/248 |

*Primary Examiner*—Richard A. Schacher

*Attorney, Agent, or Firm*—Ross, Howison, Clapp & Korn

[57] ABSTRACT

A device (10) for advancing documents (12) from an input location (14) to an output location (16) along a path includes belts (24, 26) for capturing a document (12) and for temporarily imparting a stiffness to the document that is greater than the inherent document stiffness. Structure (34, 60) is provided for driving belts (24, 26) to move the document (12) from the input location (14) to the output location (16) along the path. A guide (90) is disposed adjacent the belts (24, 26) and along the path for contacting the edges of the document (12) to thereby cause lateral aligning shifts of the document (12) transverse to the direction of document (12) advance, while the document (12) is captured by belts (24, 26) and while the document (12) is being advanced along the path.

1 Claim, 1 Drawing Sheet

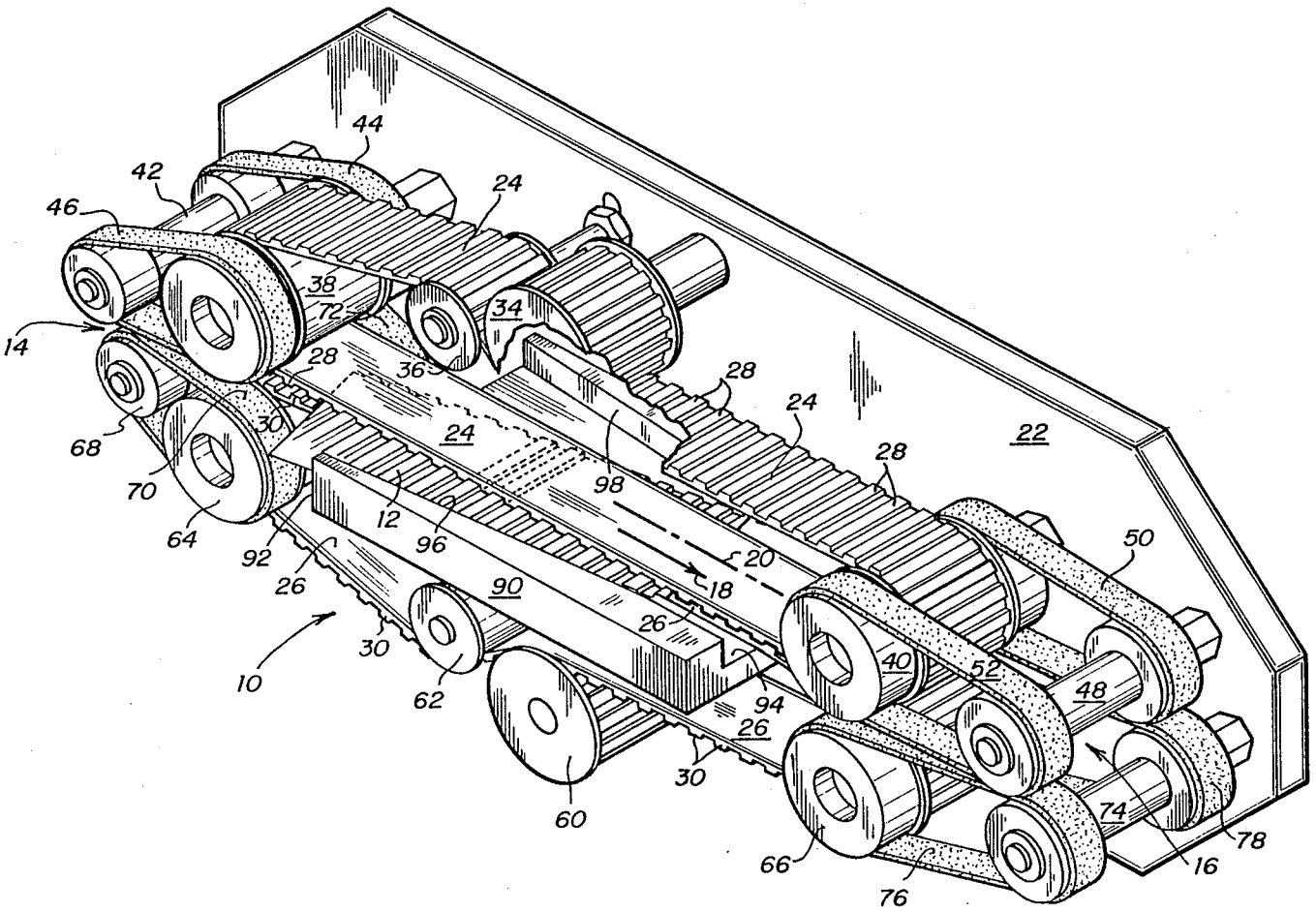
10
12
14
16
18
20
22
24
26
28
30
34
36
38
40
42
44
46
48
50
52
60
62
64
66
68
70
72
74
76
78
90
92
94
96
98

DOCUMENT TRANSPORT DEVICE

TECHNICAL FIELD

This invention relates to document transports, and more particularly to a dual belt drive for such a transport in which the dual belts provide corrugation to a document to allow for alignment of the document during transport.

BACKGROUND OF THE INVENTION

Document transport mechanisms that require document alignment generally include belt areas that loosely confine a flat document and further include angled rollers, air pressure or guides to move the flat document against an edge. These alignment techniques are sufficient for documents that have a body or stiffness such that the aligning structure acts against the document to center and align the document. However, where the documents are limp and have little inherent stiffness such as, for example, as found in worn currency, previously existing alignment structure for document transports do not properly position and accurately align documents. A need has thus arisen for a document transport device for a document processing system for light documents having little inherent stiffness in which such documents are properly positioned and accurately aligned.

SUMMARY OF THE INVENTION

In accordance with the present invention, a device for aligning and advancing documents from an input location to an output location along a path is provided. Each of the documents has a front, back and edges, and an inherent stiffness. Structure is provided for capturing a document and for temporarily imparting a stiffness to the document that is greater than the inherent document stiffness. Structure is provided for driving the capturing device to move the document from the input location to the output location along the path. A guide is disposed adjacent the document capturing structure and along the path for contacting the edges of the document to thereby cause lateral aligning shifts of the document, transverse to the direction of document advance, while the document is captured by the capturing structure and while the document is being advanced along the path.

BRIEF DESCRIPTION OF THE DRAWING

For a more complete understanding of the present invention and for further advantages thereof, reference is now made to the following Description taken in conjunction with the accompany Drawing which is a perspective view of the present document transport device.

DESCRIPTION OF THE PREFERRED EMBODIMENTS

Referring to the FIGURE, the present document transport device is illustrated and is generally identified by the numeral 10. Document transport device 10 is utilized, for example, in a document processing system in which currency notes or documents are automatically or manually input into the system for alignment prior to various processing operations. Such a document processing system is illustrated in U.S. Pat. No. 4,196,846 which includes various read stations, print stations, and document sort stations along a transport path. Prior to these document processing operations, a document must be properly positioned and accurately aligned, which is the purpose of the present invention. The FIGURE illustrates a document 12 such as a currency note; however, the present invention can be utilized with any type of document or size of document particularly where the document is light and has a low inherent stiffness making it difficult to align and center the document along a transport path.

Note 12 is transported within document transport device 10 from an input location 14 to an output location 16 and travels generally along a linear path through device 10 in the direction of arrow 18. Due to improper insertion of note 12 at input location 14, the note 12 may be skewed in either direction with respect to a nominal centerline illustrated by reference numeral 20 of the desired alignment.

Document transport device 10 is mounted to a frame 22 and includes two continuous belts 24 and 26 which include a plurality of teeth 28 and 30, respectively. Teeth 28 of belt 24 and teeth 30 of belt 26 interlock in the area between input location 14 and output location 16 to capture note 12 therebetween. Note 12 is loosely held between belts 24 and 26 such that the meshing of teeth 28 and 30 conforms note 12 to the general tooth configuration of belts 24 and 26 to thereby corrugate note 12. The corrugated note 12 has a stiffness which is greater than the inherent stiffness of note 12 in an uncorrugated configuration.

Teeth 28 of belt 24 engage a sprocketed drive motor pulley 34 which drives belt 24 in a circular path around rollers 36, 38 and 40. Movement of belt 24 imparts rotation to rollers 38 and 40. Roller 38 is interconnected to a roller 42 through belts 44 and 46. Roller 40 is interconnected to a roller 48 through belts 50 and 52. In a similar manner, belt 26 is driven by a sprocketed drive motor pulley 60 which drives belt 26 over a circular path defined by rollers 62, 64 and 66. The movement of belt 26 imparts rotational motion to rollers 64 and 66. Roller 64 is interconnected to a roller 68 through a belt 70 and a belt 72. Roller 66 is interconnected to a roller 74 through belts 76 and 78.

Belts 24 and 26 are driven in synchronization by pulleys 34 and 60 and mesh together with sufficient tension so that note 12 is retained therebetween for transport through device 10 and held loosely enough so that note 12 can also slide within belts 24 and 26.

Document 12 is initially advanced into document transport device 10 at input location 14 by the movement of belts 44, 46, 70, and 72 which captures note 12 therebetween. Note 12 is then transferred from between the above referenced belts to lie between belts 24 and 26. After note 12 is centered and has been transported through device 10, belts 50, 52, 76, and 78 function to transport note 12 from device 10 and from between belts 24 and 26 to output location 16.

A guide member 90 is positioned within document transport device 10 along the path of travel of note 12 and below belts 24 and 26 when these belts are meshed. Guide member 90 includes an input end 92 and an output end 94. Input end 92 has a greater width than output end 94. Output end 94 has a width corresponding to the width of the note 12. Extending between input end 92 and output end 94 of guide member 90 are side walls 96 and 98. Side walls 96 and 98 contact the corrugated edges of note 12 to thereby cause note 12 to laterally shift within belts 24 and 26 towards the center 20 of the document transport path through device 10. Side walls 96 and 98 act on the corrugated edges of note 12 which provide sufficient stiffness to note 12 so that side walls 96 and 98 can impart a lateral force to note 12 to deskew note 12. Note 12 is therefore simultaneously transported through device 10 between input location 14 and output location 16 while being laterally moved within belts 24 and 26 transverse to the direction 18 of the advance of note 12, such that note 12 is advanced and centered by document transport device 10. As note 12 passes between belts 50 and 78 and 52 and 76, the corrugation imparted by the teeth 28 and 30 of belts 24 and 26, respectively, is removed such that note 12 is properly aligned for subsequent document processing operations.

It therefore can be seen that the present document transport device simultaneously transports a document while aligning the document. The present device temporarily provides greater stiffness to the document to allow a guide to impart translational motion to the document to position and center the document for subsequent document processing steps.

Whereas the present invention has been described with respect to specific embodiments thereof, it will be understood that various changes and modifications will be suggested to one skilled in the art and it is intended to encompass such changes and modifications as fall within the scope of the appended claims.

I claim:

1. A document transport device for aligning documents moving along a path, each of the documents having a front, back and edges, the device comprising:

a guide for receiving the documents, said guide including an input end and an output end, said ends being connected by spaced apart first and second sidewalls, the distance between said sidewalls at said input end being greater than the distance between said sidewalls at said output end, and said distance continuously decreasing from said input end to said output end;

first and second belts disposed between said guide sidewalls for movement between said input end and said output end, said belts engaging the front and back of the document for advancing the document along the path through said guide;

said first and second belts including a plurality of interengaging teeth disposed transversely to the direction of document advance, said belts engaging each other with the document therebetween to corrugate the document and thereby temporarily impart a stiffness to the document that is greater than the inherent document stiffness, such that the corrugated edges of the document contact said guide sidewalls, said guide sidewalls thereby aligning the document towards the center of the path by sliding the document, having said greater stiffness, transversely to the direction of document advance while the document is engaged by said belts and while the document advances along the path from said guide input end to said guide output end; and means for driving said belts.

* * * * *